US006863747B2

(12) United States Patent
Kashiwazaki et al.

(10) Patent No.: US 6,863,747 B2
(45) Date of Patent: Mar. 8, 2005

(54) ALUMINUM SHEET MATERIAL FOR AUTOMOBILE AND METHOD OF PRODUCING THE SAME

(75) Inventors: Kazuhisa Kashiwazaki, Tokyo (JP); Yoichiro Bekki, Tokyo (JP); Noboru Hayashi, Wako (JP)

(73) Assignees: Furukawa-Sky Aluminum Corp., Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/978,063

(22) Filed: Oct. 17, 2001

(65) Prior Publication Data

US 2002/0043312 A1 Apr. 18, 2002

Related U.S. Application Data

(62) Division of application No. 09/462,744, filed as application No. PCT/JP99/02547 on May 17, 1999, now Pat. No. 6,325,870.

(30) Foreign Application Priority Data

May 15, 1998 (JP) ..... 10-133918

(51) Int. Cl.[7] ..... C22F 1/043; C22C 21/02

(52) U.S. Cl. ..... 148/439; 148/692; 420/532; 420/535; 420/538

(58) Field of Search ..... 148/692, 439; 420/532, 535, 538

(56) References Cited

U.S. PATENT DOCUMENTS 4,718,948 A 1/1988 Komatsubara et al.

FOREIGN PATENT DOCUMENTS

| | | | |
|---|---|---|---|
| DE | 3008358 | | 3/1980 |
| JP | 56-139667 A | | 10/1981 |
| JP | 58-31054 | | 2/1983 |
| JP | A-4-32532 | | 2/1992 |
| JP | A-9-143605 | | 6/1997 |
| JP | 09-256095 A | * | 6/1997 |
| JP | A-9-249949 | | 9/1997 |
| JP | 9-256095 A | | 9/1997 |
| JP | 10-110232 A | * | 4/1998 |

OTHER PUBLICATIONS

"Aluminum and Aluminum Alloys", ASM International (1993), p 290–297, 319.*

* cited by examiner

*Primary Examiner*—George Wyszomierski
*Assistant Examiner*—Janelle Combs Morillo
(74) *Attorney, Agent, or Firm*—Birch, Stewart, Kolasch & Birch, LLP

(57) ABSTRACT

An aluminum sheet material for automobiles is herein disclosed, having an aluminum alloy composition: (i) comprising 3.5 to 5 wt % of Si, 0.3 to 1.5 wt % of Mg, 0.4 to 1.5 wt % of Zn, 0.4 to 1.5 wt % of Cu, 0.4 to 1.5 wt % of Fe, and 0.6 to 1 wt % of Mn, and one or more members selected from the group of 0.01 to 0.2 wt % of Cr, 0.01 to 0.2 wt % of Ti, 0.01 to 0.2 wt % of Zr, and 0.01 to 0.2 wt % of V, with the balance of aluminum and unavoidable impurities, or (ii) comprising between more than 2.6 wt % and 5 wt % of Si, 0.2 to 1.0 wt % of Mg, 0.2 to 1.5 wt % of Zn, 0.2 to 1.5 wt % of Cu, 0.2 to 1.5 wt % of Fe, and between 0.05 and less than 0.6 wt % of Mn, and one or more members selected from the group of 0.01 to 0.2 wt % of Cr, 0.01 to 0.2 wt % of Ti, 0.01 to 0.2 wt % of Zr, and 0.01 to 0.2 wt % of V, with the balance of aluminum and unavoidable impurities. It is possible to produce an aluminum sheet material for automobiles that has excellent mechanical strength and bending property as well as enhanced weldability, by making the recycling use of recycled aluminum materials.

5 Claims, No Drawings

ALUMINUM SHEET MATERIAL FOR AUTOMOBILE AND METHOD OF PRODUCING THE SAME

This application is a divisional of application Ser. No. 09/462,744, filed on Feb. 16, 2000 now U.S. Pat. No. 6,325,870 and for which priority is claimed under 35 U.S.C. § 120. Application Ser. No. 09/462,744 is the national phase of PCT International Application No. PCT/JP99/02547 filed on May 17, 1999 under 35 U.S.C. § 371. The entire contents of each of the above-identified applications are hereby incorporated by reference. This application also claims priority of Application No. 133918/1998 filed in Japan on May 15, 1998 under 35 U.S.C. § 119.

This application is the national phase under 35 U.S.C. § 371 of PCT International Application No. PCT/JP99/02547 which has an International filling date of May 17, 1999, which designated the United States of America.

TECHNICAL FIELD

The present invention relates to an aluminum sheet material having excellent mechanical strength, press formability, bending property, and weldability; and, more particularly, to an aluminum sheet material for automobiles that can be produced at low cost by making sue of recovered aluminum materials, such as recycled aluminum casting scraps of automobiles, recycled aluminum can scraps, recycled aluminum sash scraps, and the like, as raw materials, and a method of producing the same.

BACKGROUND ART

Conventionally, cold-rolled steel sheets have been mainly used for automotive body panels. In recent years, however, there has been a strong demand for reducing the weight of automobile bodies, from the viewpoint of improving mileage, and the use of aluminum sheets or plates instead of steel sheet has been studied. Further, aluminum sheets are now actually being utilized for part of automobile bodies. Excellent press formability, high mechanical strength, good corrosion resistance, and the like are required for the aluminum sheets as a material of automotive body panels. An Al—Mg—Si alloy (6000-group alloy), such as 6061-alloy and the like, has been conventionally used as an aluminum alloy for a material to meet such demands as described above.

However, there have been problems that sufficient weldability cannot be obtained by the aforementioned 6000-group alloy, the cost of the aforementioned 6000-group alloy is higher than that of steel sheet, and the like.

An object of the present invention is to provide an aluminum sheet material whose weldability is improved while ensuring mechanical strength and bending property required for a material for automobile body panels.

Another object of the present invention is to provide an aluminum sheet material possessing such characteristics required for a material for automobile body panels, which can be produced at low cost by making use of recycled aluminum materials.

DISCLOSURE OF INVENTION

The present inventors have studied in earnest taking the aforementioned problems into consideration. Consequently, the present inventors found that an aluminum sheet material having the following specific composition could solve the aforementioned problems. The present invention was attained based on that finding.

(1) An aluminum sheet material for automobiles, which comprises 3.5 to 5 wt % of Si, 0.3 to 1.5 wt % of Mg, 0.4 to 1.5 wt % of Zn, 0.4 to 1.5 wt % of Cu, 0.4 to 1.5 wt % of Fe, and 0.6 to 1 wt % of Mn, and comprises one or more members selected from the group of 0.01 to 0.2 wt % of Cr, 0.01 to 0.2 wt % of Ti, 0.01 to 0.2 wt % of Zr, and 0.01 to 0.2 wt % of V, with the balance of aluminum and unavoidable impurities.

(2) A method of producing an aluminum sheet material for automobiles that is the aluminum sheet material for automobiles as stated in the above (1), wherein at least one member selected from the group of automobile aluminum parts scraps containing 2.5 wt % or above of Si, aluminum can scraps containing 1 wt % or above of Mg, or aluminum sash scraps containing 0.2 wt % or above of Mg, is used as at least a part of aluminum alloy casting ingot.

(3) The method of producing an aluminum sheet material for automobiles as stated in the above (2), wherein the recycled scraps can be used up to maximum 100% as raw materials for the aluminum alloy casting ingot.

(4) An aluminum sheet material for automobiles, which has an aluminum alloy composition comprising between more than 2.6 wt % and 5 wt % of Si, 0.2 to 1.0 wt % of Mg, 0.2 to 1.5 wt % of Zn, 0.2 to 1.5 wt % of Cu, 0.2 to 1.5 wt % of Fe, and between 0.05 and less than 0.6 wt % of Mn, and comprising one or more members selected from the group of 0.01 to 0.2 wt % of Cr, 0.01 to 0.2 wt % of Ti, 0.01 to 0.2 wt % of Zr, and 0.01 to 0.2 wt % of V, with the balance of aluminum and unavoidable impurities.

(5) A method of producing an aluminum sheet material for automobiles that is the aluminum sheet material for automobiles as stated in the above (4), wherein automobile aluminum parts scraps are used for at least a part of raw materials of a casting ingot for the aluminum alloy, in the production of the aluminum sheet material for automobiles.

(6) The method of producing an aluminum sheet material for automobiles that is the aluminum sheet material for automobiles as stated in the above (1) or (4), wherein reduction from a casting ingot to a final product is 98% or above, in the production of the aluminum sheet material for automobiles.

BEST MODE FOR CARRYING OUT THE INVENTION

A first embodiment of the aluminum sheet material for automobiles of the present invention is an aluminum sheet material for automobiles, characterized by comprising 3.5 to 5 wt % of Si, 0.3 to 1.5 wt % of Mg, 0.4 to 1.5 wt % of Zn, 0.4 to 1.5 wt % of Cu, 0.4 to 1.5 wt % of Fe, and 0.6 to 1 wt % of Mn, and further comprising one or more members selected from the group of 0.01 to 0.2 wt % of Cr, 0.01 to 0.2 wt % of Ti, 0.01 to 0.2 wt % of Zr, and 0.01 to 0.2 wt % of V, with the balance of aluminum and unavoidable impurities.

The aluminum sheet material of the first embodiment is described more in detail.

Si content is generally 3.5 to 5 wt %. Si improves the mechanical strength of Al sheet material and ensures the required elongation. If the Si content is too low, such effects will be insufficient. Further, if the Si content is too high, elongation lowers, and further the bending property also lowers.

Mg content is generally 0.3 to 1.5 wt %, preferably 0.3 to 0.8 wt %. Mg forms an intermetallic compound with the above-mentioned Si and improves mechanical strength by deposition of $Mg_2Si$. If the Mg content is too low, such effects are insufficient, and when too high, elongation lowers.

Zn content is generally 0.4 to 1.5 wt %, preferably 0.4 to 1.2 wt %. Zn lowers the melting point of Al sheet material of the present invention and improves spot weldability, simultaneously improving surface treatment property, thereby improving the degreasing property and the chemical conversion property. When the Zn content is too low, the chemical conversion property is poor, and when too high, corrosion resistance deteriorates.

Cu content is generally 0.4 to 1.5 wt %, preferably 0.4 to 1.2 wt %. Cu lowers the electric conductivity and the melting point of Al sheet material, and improves spot weldability. Further it contributes to improving impact absorption energy, because of enhancement of the mechanical strength of Al sheet material. When the Cu content is too low, such effects are insufficient, and when too high, elongation lowers.

Fe content is generally 0.4 to 1.5 wt %, preferably 0.4 to 1.2 wt %. Fe contributes to improving toughness and impact absorption energy, because of grain refining. When the Fe content is too low, such effects are insufficient, and when too high, surface appearance deteriorates, because of a large crystallized phase.

Mn content is generally 0.6 to 1.0 wt %, preferably 0.6 to 0.8 wt %. Mn lowers the electric conductivity of Al sheet material, and enhances the mechanical strength thereof. When the Mn content is too low, such effects are insufficient, and when too high, elongation and bending property lower.

Further, an element selected from the group of Cr, Ti, Zr, and V improves the bending property and toughness of Al sheet material of the first embodiment, by grain refining, thereby improving press formability and energy absorptivity. Cr content is generally 0.01 to 0.2 wt %, preferably 0.01 to 0.1 wt %; Ti content is generally 0.01 to 0.2 wt %, preferably 0.01 to 0.1 wt %; Zr content is generally 0.01 to 0.2 wt %, preferably 0.01 to 0.1 wt %, and V content is generally 0.01 to 0.2 wt %, preferably 0.01 to 0.1 wt %.

A second embodiment of the present invention is an aluminum sheet material for automobiles, characterized by having an aluminum alloy composition comprising, as essential elements, between more than 2.6 wt % and 5 wt % of Si, 0.2 to 1.0 wt % of Mg, 0.2 to 1.5 wt % of Zn, 0.2 to 1.5 wt % of Cu, 0.2 to 1.5 wt % of Fe, and between 0.05 and less than 0.6 wt % of Mn, and further comprising one or more members selected from the group of 0.01 to 0.2 wt % of Cr, 0.01 to 0.2 wt % of Ti, 0.01 to 0.2 wt % of Zr, and 0.01 to 0.2 wt % of V, with the balance of aluminum and unavoidable impurities. The second embodiment is characterized in that the amount to be added of each of Mg and Mn is small in comparison with the first embodiment, and that the lower limit value of the amount to be added of each of Zn, Cu, Fe, and the like is lowered.

In this second embodiment, the Si content is generally between more than 2.6 wt % and 5 wt %, preferably between more than 2.6 wt % and 4 wt %. Si enhances the mechanical strength of Al sheet material and ensures the required elongation. When the Si content is too low, such effects are insufficient, and when the Si content is too high, elongation lowers, and the bending property also lowers in some cases.

Mg content is generally 0.2 to 1.0 wt %, preferably 0.2 to 0.8 wt %. Mg forms an intermetallic compound with the above Si and improves mechanical strength by deposition of $Mg_2Si$. When the Mg content is too low, such effects are insufficient, and when too high, the bending property and impact properties, as well as elongation, lower.

Zn content is generally 0.2 to 1.5 wt %, preferably 0.2 to 1.2 wt %. Zn improves surface treatment property of the alloy, thereby improving the degreasing property and the chemical conversion property. When the Zn content is too low, the chemical conversion property is poor, and when too high, corrosion resistance deteriorates.

Cu content is generally 0.2 to 1.5 wt %, preferably 0.2 to 1.2 wt %. Cu lowers the electric conductivity and the melting point of Al sheet material, and improves spot weldability. Further, it contributes to improving impact absorption energy, because of enhancement of the mechanical strength of Al sheet material. When the Cu content is too low, such effects are insufficient, and when too high, elongation lowers.

Fe content is generally 0.2 to 1.5 wt %, preferably 0.2 to 1.2 wt %. Fe contributes to improving toughness and impact absorption energy, because of grain refining. When the Fe content is too low, such effects are insufficient, and when too high, surface appearance deteriorates, because of a large crystallized phase.

Mn content is generally between 0.05 wt % and less than 0.6 wt %. Mn lowers the electric conductivity of Al sheet material, and enhances the mechanical strength thereof. When the Mn content is too low, such effects are insufficient, and when too high, elongation and the bending property lower.

In the case of the aluminum sheet material for automobiles of the second embodiment, the level of content of alloy elements may be lower than that of the first embodiment. Accordingly, aluminum can scraps, aluminum alloy-made heat exchanger parts scraps, and the like, whose contents of these elements are small, can be recycled to use as raw materials of an alloy casting ingot. In the case of the second embodiment, the mechanical strength is lower in comparison with the first embodiment, but an excellent Charpy impact value, as well as bending property and the like, can be obtained, which are characteristics not present in the first embodiment.

Further, in the second embodiment, an element selected from the group of Cr, Ti, Zr, and V improves the bending property and toughness of Al sheet material, by grain refining, thereby improving press formability and energy absorptivity. Cr content is generally 0.01 to 0.2 wt %, preferably 0.01 to 0.1 wt %; Ti content is generally 0.01 to 0.2 wt %, preferably 0.01 to 0.1 wt %; Zr content is generally 0.01 to 0.2 wt %, preferably 0.01 to 0.1 wt %, and V content is generally 0.01 to 0.2 wt %, preferably 0.01 to 0.1 wt %.

The aluminum sheet material for automobiles of the present invention, including each embodiment described above, is characterized by containing, as essential elements other than aluminum, Si, Mg, Zn, Cu, Fe, and Mn, in the proportions described above, and further containing at least one or more member selected from the group of Cr, Ti, Zr, and V, in the proportions described above, and the said material exhibits excellent mechanical strength, press formability, bending property, and weldability, by having such an alloy composition as described above. There is a case where an alloy composition may be unavoidably contaminated with impurities other than the elements described above, but it is needless to say that any measures can be taken so that the presence of such impurities does not introduce a problem, in order to obtain the effects described above.

Since an aluminum alloy used in the present invention contains Si and Zn in large amounts, it is possible to recycle and utilize various kinds of metal scraps (aluminum scrap) as raw materials. Scraps to be recycled that can be used include, for example, recycled aluminum can scraps, recycled aluminum sash scraps, and parts scraps, including aluminum-made engine scraps of automobiles, and the like. Preferably, use may be made of, as a part of raw materials, a recycled material, such as aluminum scraps containing a large amount of Si, including automotive aluminum parts scraps containing preferably 2.5 wt % or above of Si, more preferably 2.5 wt % to 14 wt % of Si, or aluminum scraps containing a large amount of Mg, including aluminum can scraps containing preferably 1 wt % or above of Mg, more preferably 1 wt % to 2 wt % of Mg, or aluminum sash scraps containing preferably 0.2 wt % or above of Mg, more preferably 0.2 wt % to 1 wt % of Mg, and the like. In this case, the recycled scraps may be subjected to purification treatment if necessary, and the purification treatment for reducing Si, Zn, Mg, Cu, and the like can be carried out by a usual method. Such a purification treatment process itself is publicly known, as described in, for example, JP-A-7-54061 ("JP-A" means unexamined published Japanese Patent Application), JP-A-7-19714, and the like, and such a process can be carried out according thereto. Such scraps may be relatively readily available, thereby reducing the cost of raw materials. In order to obtain the aluminum sheet material of the present invention, adjusting the alloy elements may be feasible, for example, by combining such recycled scraps as described above with an aluminum alloy, or by adding a pure aluminum ingot or a given element(s) thereto, and thereby materials having required characteristics can be obtained. Further, an alloy may be prepared in fusion by adjusting the elements from the start, not depending on recycled scraps.

An embodiment for recycling the scraps for the aluminum alloy material is described. Preferably, from the viewpoint of recycling, the aluminum sheet material of the present invention contains 30 wt % or above, more preferably 45 wt % or above, of a portion originated from the above aluminum can scraps, aluminum sash scraps, and automobile parts scraps, based on the weight of casting ingot materials. Further, according to the present invention, 100 wt % of recycled scraps (that is, 100% of scraps) may be used as an aluminum alloy material. Further, since recycled scraps may occupy a large portion, and pure aluminum and additional elements may be added for the remainder, to adjust the alloy elements, it is also possible not only to dilute but also to increase the amount of predetermined elements to be added.

The shape of the aluminum sheet material for automobiles of the present invention may be a sheet, strip, and the like.

The method for production of the aluminum sheet material for automobiles of the present invention is not particularly different from that of the conventional method, except that such scraps of recovered and recycled aluminum alloy material as described above can be used, and the production can be carried out in a usual manner.

For example, the process comprises the steps of melting, casting, homogenizing treatment, hot-rolling, and cold-rolling, and a preferable process is to carry out final annealing by a continuous annealing line (CAL) after cold-rolling.

Preferable conditions of each step herein are, for example, homogenizing treatment at 520° C. for one hour or above, and cooling at 3° C./sec or above, after final annealing at reachable temperatures up to 530° C.

In the method of the production of the aluminum sheet material for automobiles of the present invention, the reduction from a casting ingot to a final product differs depending on the composition of aluminum alloy, the application of the resultant member, and the like, and it is not particularly limited, but it can be properly determined, and it is preferably 90% or above, more preferably 98% or above. Such higher reduction improves toughness of the aluminum sheet material and a high Charpy impact value can be obtained, as shown apparently in Example 2 herein, described later. A T4 material may be used as an aluminum sheet material for automobiles when bending conditions are severe, and a T5 material may be used as an aluminum sheet material for automobiles when bending conditions are not so severe but mechanical strength is important. The aluminum sheet material for automobiles of the present invention can be used as a T4 or as a T5 according to the occasion.

EXAMPLES

The present invention is described in more detail based on the following examples, but the invention is not limited to those.

Example 1

Aluminum sheet materials having compositions shown in Table 2 were prepared according to the following process, by using recycled scraps and pure aluminum (not recycled scraps) as raw materials in the proportions shown in the following Table 1. The composition of each of the automobile aluminum parts scraps, aluminum can scraps, and aluminum sash scraps used in preparation is shown in Table 3. In the production of these sheet materials, the reduction from a casting ingot to a final product was 98%. The composition of the automobile aluminum parts scraps varied among lots of raw material, as shown in Table 3, described later. Accordingly, each Alloy A~F having the composition shown in Table 2 was obtained by properly selecting from raw material lots. The same is applied to Example 2, described later.

Raw materials were fused in the proportions shown in Table 1, and they were subjected to casting, to homogenizing treatment (520° C., one hour), to hot-rolling, to cold-rolling, and then to final annealing (530° C.), and thereafter to cooling at 3° C./sec, to obtain Aluminum sheet materials $A_1$~$F_1$ (T4 material), which were thereafter subjected to aging treatment (180° C.×2 hours), to obtain Aluminum sheet materials $A_2$~$F_2$ (T5 material). These sheet materials were tested for the following characteristics, and the results obtained are shown in Tables 4 and 5.

TABLE 1

| | Automobile aluminium parts scraps (wt %) | Can scraps (wt %) | Sash scraps (wt %) | Aluminium (wt %) |
|---|---|---|---|---|
| A | 50 | 50 | — | — |
| B | 60 | — | 40 | — |
| C | 30 | 40 | — | 30 |
| D | 30 | — | 30 | 40 |
| E | 70 | 30 | — | — |
| F | 30 | — | 50 | 20 |

Methods of testing characteristic were as follows.

1. Tension Test (Tensile Strength, Proof Strength, Elongation Value)

A JIS No. 5-type specimen was prepared and subjected to tension testing at a tension speed of 10 mm/min, by an Instron-type tension tester, to obtain tensile strength, proof strength, and elongation value.

2. Bending Property Test

A JIS No. 3-type bending specimen was prepared, and using this, V-shape bending testing at 90° was carried out at the edge R:2.5 mm for T4 material, and at the edge R:3 mm for T5 material. A specimen in which no cracks occurred was evaluated as "GOOD," and a specimen in which cracks occurred was evaluated as "NO GOOD."

3. Minimum Electric Current Required When Spot Welding

A single-phase AC spot welding machine, equipped with 1% Cr—Cu alloy-made R-type electrodes, was used, using an applied force of 2942N (300 kgf), to carry out the test. Spot welding was carried out by a method in which two 2-mm thickness sheets were superposed upon each other, force applied to the sheets was maintained for a given time, and then a welding electric current was applied while maintaining the applied force, a constant welding electric current was maintained for a given time, and then the applied force was maintained until a nugget portion of the material was completely solidified, even after application of the electric current was finished. The mechanical strength of the welded material was evaluated by shear testing by means of a tensile machine, to obtain the minimum electric current value required for obtaining a given strength (300 kgf).

4. Rate of Occurrence of "NO GOOD" in Spot Welding

A single-phase AC spot welding machine, equipped with 1% Cr—Cu alloy-made R-type electrodes, was used, using an applied force of 2942N (300 kgf), to carry out the test. Spot welding was carried out by a method in which a superposed sheet, 2 mm in thickness, was maintained under applied force for a given time, to which a welding electric current was applied while maintaining the applied force, the constant welding electric current was maintained for a given time, and then the applied force was maintained until a nugget portion of the material was completely solidified, even after application of the electric current was finished. The number of nuggets in 500 spots welds, the diameter of which did not reach the minimum value of 5.1 mm shown in JIS B class, was regarded as the occurrence number of "NO GOOD" in spot welding, to evaluate spot weldability. An occurrence number of "NO GOOD" of two or below was evaluated as passed the test "○", and a number of three or above was evaluated as failed the test "X". The reason two or below was an occurrence number of "NO GOOD" passed the test is that a "NO GOOD" occurrence number of up to two is a level practically allowable for the variation in spot size in 5000 spots welding.

TABLE 2

| Alloy number | Composition (wt %) Cu | Fe | Si | Mn | Mg | Cr | Ti | Zn | Al | Remarks |
|---|---|---|---|---|---|---|---|---|---|---|
| A | 1.10 | 0.85 | 5.80 | 0.91 | 0.79 | 0.02 | 0.01 | 0.92 | Balance | Mixture of automobile aluminium parts scraps and can scraps |
| B | 1.09 | 1.12 | 6.40 | 0.63 | 0.41 | 0.04 | 0.02 | 1.25 | Balance | Mixture of automobile aluminium parts scraps and sash scraps |
| C | 0.70 | 0.66 | 3.51 | 0.79 | 0.71 | 0.03 | 0.02 | 0.55 | Balance | Purification-treated mixture of automobile aluminium parts scraps and can scraps |
| D | 0.57 | 0.71 | 3.71 | 0.61 | 0.33 | 0.02 | 0.01 | 0.83 | Balance | Purification-treated mixture of automobile aluminium parts scraps and sash scraps |
| E | 1.02 | 0.95 | 8.50 | 0.56 | 0.97 | 0.02 | 0.01 | 1.11 | Balance | Mixture of automobile aluminium parts scraps and can scraps |
| F | 0.61 | 0.78 | 3.35 | 0.62 | 0.45 | 0.03 | 0.01 | 0.66 | Balance | Purification-treated mixture of automobile aluminium parts scraps and sash scraps |

TABLE 3

| Alloy number | Composition (wt %) Cu | Fe | Si | Mn | Mg | Cr | Ti | Zn | Al |
|---|---|---|---|---|---|---|---|---|---|
| Automobile aluminium parts scraps | 1.4 to 2.4 | 1.0 to 1.6 | 9.0 to 13 | 0.1 to 1.9 | 0.05 to 0.8 | 0.01 to 0.1 | 0.01 to 0.05 | 1.5 to 2.8 | Balance |
| Can scraps | 01 | 0.4 | 0.2 | 0.8 | 1.5 | 0.01 | 0.01 | 0.01 | Balance |
| Sash scraps | 0.01 | 0.78 | 0.65 | 0.18 | 0.48 | 0.01 | 0.01 | 0.01 | Balance |

TABLE 4

| | Example of this invention | | | | Comparative example | |
|---|---|---|---|---|---|---|
| Sample No. | $A_1$ | $B_1$ | $C_1$ | $D_1$ | $E_1$ | $F_1$ |
| Characteristics | | | | | | |
| Tensile strength (MPa) | 311 | 305 | 276 | 270 | 331 | 232 |
| Proof strength (MPa) | 185 | 179 | 156 | 148 | 191 | 120 |
| Elongation (%) | 20.2 | 20.7 | 22.3 | 22.8 | 15.0 | 24.1 |
| Bending property | GOOD | GOOD | GOOD | GOOD | NO GOOD | GOOD |
| Minimum electric current required when spot welding (kA) | 28 | 29 | 30 | 30 | 27 | 32 |
| Occurrence number of "NO GOOD" in spot welding | | | | | | |
| 20 kA | 0 | 0 | 0 | 2 | 0 | 26 |
| 30 kA | 0 | 0 | 0 | 1 | 0 | 20 |
| Passed or failed | ○ | ○ | ○ | ○ | ○ | X |

TABLE 5

| | Example of this invention | | | | Comparative example | |
|---|---|---|---|---|---|---|
| Sample No. | $A_1$ | $B_1$ | $C_1$ | $D_1$ | $E_1$ | $F_1$ |
| Characteristics | | | | | | |
| Tensile strength (MPa) | 330 | 318 | 289 | 276 | 356 | 247 |
| Proof strength (MPa) | 227 | 214 | 208 | 199 | 278 | 179 |
| Elongation (%) | 14.3 | 15.6 | 16.3 | 16.9 | 10.8 | 18.1 |
| Bending property | GOOD | GOOD | GOOD | GOOD | NO GOOD | GOOD |
| Minimum electric current required when spot welding (kA) | 28 | 29 | 30 | 30 | 28 | 32 |
| Occurrence number of "NO GOOD" in spot welding | | | | | | |
| 20 kA | 0 | 0 | 0 | 2 | 0 | 28 |
| 30 kA | 0 | 0 | 0 | 1 | 0 | 21 |
| Passed or failed | ○ | ○ | ○ | ○ | ○ | X |

As is apparent from the results of Table 4 and Table 5 in both cases of T4 and T5, since the samples $E_1$ and $E_2$ of Comparative examples were high in mechanical strength and low in elongation, they had insufficient bending property. Further, the samples $F_1$ and $F_2$ were good in bending property and large in elongation, but they were low in mechanical strength, and the occurrence number of "NO GOOD" in spot welding was large.

On the contrary, the samples $A_1$~$D_1$ and $A_2$~$D_2$ according to the present invention were excellent in mechanical strength and elongation, and good in bending property. Further, the minimum electric current required for spot welding was low, the occurrence rate of "NO GOOD" in spot welding was low, and weldability was also excellent.

Example 2

(Preparation of Samples $G_1$~$M_1$)

Automobile Aluminum parts scraps having an alloy composition shown in Table 6, and pure aluminum, were used as raw materials of casting ingot, which were mixed and fused in the proportions shown in Table 7. The parts scraps described above were subjected to purification treatment when necessary. A casting ingot of the size 300 mm (width)×1200 mm (length)×120 mm (thickness) was cast, which was then subjected to homogenizing treatment at 520° C.×one hour, and to hot-rolling at a starting temperature of 480° C. and a finishing temperature of 340° C., to prepare a sheet 2 mm in thickness (reduction: 98.3%), which was then subjected to final annealing at 530° C., and thereafter it was cooled at 3° C./sec, to prepare Aluminum sheet material samples $G_1$~$M_1$ (T4 material). The compositions of aluminum alloys G~M constituting each sheet material are as shown in Table 8.

(Preparation of Samples $G_2$~$M_2$)

Aluminum sheet material samples $G_2$~$M_2$ were prepared in the same manner as described above, except that the reduction was changed to 96%. The compositions of aluminum alloys G~M constituting each sheet material are as shown in Table 8, similarly to those of Samples $G_1$~$M_1$.

TABLE 6

| | Composition (wt %) | | | | | | | | |
|---|---|---|---|---|---|---|---|---|---|
| | Cu | Fe | Si | Mn | Mg | Cr | Ti | Zn | Al |
| Automobile aluminium parts scraps | 1.4~2.4 | 1.0~1.6 | 9.0~13 | 0.1~1.9 | 0.05~0.8 | 0.01~0.1 | 0.01~0.05 | 1.5~2.8 | Balance |

TABLE 7

| | Automobile aluminium parts scraps (wt %) | Aluminium (wt %) |
|---|---|---|
| G | 35 | 65 |
| H | 100 | 0 |
| I | 50 | 50 |
| J | 50 | 50 |
| K | 100 | 0 |
| L | 40 | 60 |
| M | 40 | 60 |

TABLE 8

| | Composition (wt %) | | | | | | | | | |
|---|---|---|---|---|---|---|---|---|---|---|
| | Cu | Fe | Si | Mn | Mg | Cr | Ti | Zn | Al | Remarks |
| G | 0.84 | 0.61 | 3.95 | 0.23 | 0.28 | 0.02 | 0.01 | 0.83 | Balance | Automobile aluminium parts scraps, aluminium |

TABLE 8-continued

| | Composition (wt %) | | | | | | | | | |
|---|---|---|---|---|---|---|---|---|---|---|
| | Cu | Fe | Si | Mn | Mg | Cr | Ti | Zn | Al | Remarks |
| H | 1.22 | 1.09 | 4.88 | 0.26 | 0.37 | 0.03 | 0.04 | 1.20 | Balance | Automobile aluminium parts scraps, purification treatment |
| I | 0.66 | 0.79 | 2.65 | 0.51 | 0.46 | 0.01 | 0.01 | 0.71 | Balance | Automobile aluminium parts scraps, aluminium, purification treatment + addition of Mg |
| J | 0.30 | 0.30 | 2.80 | 0.50 | 0.32 | 0.04 | 0.02 | 0.30 | Balance | Automobile aluminium parts scraps, aluminium, purification treatment |
| K | 1.39 | 1.14 | 6.21 | 0.39 | 0.43 | 0.03 | 0.03 | 1.40 | Balance | Automobile aluminium parts scraps, purification treatment |
| L | 0.36 | 0.43 | 2.31 | 0.36 | 0.29 | 0.02 | 0.01 | 0.33 | Balance | Automobile aluminium parts scraps, aluminium, purification treatment |
| M | 0.86 | 0.71 | 4.81 | 0.45 | 0.15 | 0.02 | 0.02 | 0.80 | Balance | Automobile aluminium parts scraps, aluminium |

Characteristics tests were carried out for the above-mentioned aluminum sheet material samples $G_1$~$M_1$, and the above-mentioned aluminum sheet material samples $G_2$~$M_2$, in a manner described below. The results thus obtained were as shown in Table 9 and Table 10.

Among the test methods for each characteristics, tension testing and spot welding testing were quite the same as those in Example 1, bending property testing was different in test conditions, and the Charpy impact testing is described below, because it was not carried out in Example 1.

1. Bending Property Test

A JIS No. 3-type bending specimen was prepared, and V-shape bending testing at right angles (edge R: 1.5 mm) was carried out using the specimen. A test specimen in which no cracks occurred was evaluated as "GOOD," and a test specimen in which cracks occurred was evaluated as "NO GOOD." The bending R at the time of bending processing was smaller and more severe than in Example 1.

2. Charpy Impact Test

A JIS No. 3-type specimen (2 mm in width) was prepared and was subjected to Charpy impact testing, to obtain the Charpy impact value.

TABLE 9

| | Example of this invention | | | | Comparative example | | |
|---|---|---|---|---|---|---|---|
| Sample No. | $G_1$ | $H_1$ | $I_1$ | $J_1$ | $K_1$ | $L_1$ | $M_1$ |
| Characteristics | | | | | | | |
| Tensile strength (MPa) | 275 | 301 | 261 | 253 | 330 | 231 | 230 |
| Proof strength (MPa) | 155 | 175 | 147 | 142 | 192 | 118 | 115 |
| Elongation (%) | 23.3 | 21.8 | 24.1 | 24.8 | 15.8 | 24.9 | 25.0 |
| Bending property | GOOD | GOOD | GOOD | GOOD | NO GOOD | GOOD | GOOD |
| Charpy impact value (kgfm/cm$^2$) | 3.21 | 3.07 | 3.26 | 3.29 | 2.82 | 3.59 | 3.00 |
| Minimum electric current required when spot welding (kA) | 29 | 28 | 30 | 30 | 28 | 32 | 30 |
| Occurrence number of "NO GOOD" in spot welding | | | | | | | |
| 20 kA | 0 | 0 | 2 | 2 | 0 | 41 | 0 |
| 30 kA | 0 | 0 | 1 | 1 | 0 | 29 | 0 |
| Passed or failed | ○ | ○ | ○ | ○ | ○ | X | ○ |

TABLE 10

| | Example of this invention | | | | Comparative example | | |
|---|---|---|---|---|---|---|---|
| Sample No. | $G_2$ | $H_2$ | $I_2$ | $J_2$ | $K_2$ | $L_2$ | $M_2$ |
| Characteristics | | | | | | | |
| Tensile strength (MPa) | 274 | 303 | 260 | 255 | 327 | 235 | 233 |
| Proof strength (MPa) | 154 | 177 | 145 | 140 | 188 | 119 | 118 |
| Elongation (%) | 23.1 | 22.0 | 24.0 | 24.2 | 15.9 | 24.7 | 25.0 |
| Bending property | GOOD | GOOD | GOOD | GOOD | NO GOOD | GOOD | GOOD |
| Charpy impact value ($kgfm/cm^2$) | 2.89 | 2.76 | 2.92 | 2.95 | 2.53 | 3.25 | 3.3 |
| Minimum electric current required when spot welding (kA) | 29 | 28 | 30 | 30 | 28 | 32 | 29 |
| Occurrence number of "NO GOOD" in spot welding | | | | | | | |
| 20 kA | 0 | 0 | 2 | 2 | 0 | 38 | 0 |
| 30 kA | 0 | 0 | 0 | 0 | 0 | 21 | 0 |
| Passed or failed | ○ | ○ | ○ | ○ | ○ | X | ○ |

As is apparent from the results of Table 9 and Table 10, Samples $K_1$ and $K_2$ for comparison were high in mechanical strength and small in occurrence number of "NO GOOD" in spot welding, but they were low in elongation and had insufficient bending property. Further, although Samples $L_1$, $L_2$, $M_1$, and $M_2$ were good in bending property and high in elongation, they cannot be practically used because of low mechanical strength, and the occurrence number of "NO GOOD" in spot welding was large in Samples $L_1$ and $L_2$, respectively.

On the contrary, the samples $G_1$, $H_1$, $I_1$ and $J_1$ according to the present invention were excellent in mechanical strength and elongation, and good in bending property. Further, the minimum electric current required for spot welding was low, the occurrence rate of "NO GOOD" in spot welding was low, and weldability was also excellent. Particularly, the samples $G_1$, $H_1$, $I_1$, and $J_2$, wherein the reduction was 98% or above, were high in Charpy impact value and exhibited excellent toughness.

Industrial Applicability

The aluminum sheet material for automobiles of the present invention does not require a large quantity of electric current in spot welding; it is of high mechanical strength and bending property, and it has an excellent effect that cracks do not occur even in bending processing under severe conditions. According to the present invention, an industrially excellent effect can be attained that production of an aluminum sheet material for automobiles having excellent characteristics can be carried out at low cost by the use and recycling of recycled scraps, such as automobile aluminum parts scraps, aluminum can scraps, or aluminum sash scraps.

Having described our invention as related to the present embodiments, it is our intention that the invention not be limited by any of the details of the description, unless otherwise specified, but rather be construed broadly within its spirit and scope as set out in the accompanying claims.

What is claimed is:

1. An aluminum alloy sheet material, which comprises 3.95 to 5 wt % of Si, 0.2 to 0.8 wt % of Mg, 0.2 to 1.5 wt % of Zn, 0.2 to 1.5 wt % of Cu, 0.2 to 1.5 wt % of Fe, and between 0.05 and less than 0.6 wt % of Mn, and further comprising one or more members selected from the group consisting of 0.01 to 0.2 wt % of Cr, 0.01 to 0.2 wt % of Ti, 0.01 to 0.2 wt % of Zr, and 0.01 to 0.2 wt % of V, with the balance being aluminum and unavoidable impurities.

2. The aluminum alloy sheet material according to claim 1, wherein the aluminum alloy sheet material comprises automobile aluminum parts scraps as at least a part of raw materials for the aluminum alloy.

3. The aluminum alloy sheet material according to claim 1, wherein the aluminum alloy sheet material is excellent in resistance to impact energy and excellent in bending property.

4. The aluminum alloy sheet material according to claim 1, wherein the tensile strength is in the range of 274 MPa to 303 MPa.

5. A method of producing an aluminum alloy sheet material for automobile containing an aluminum alloy composition, which comprises 3.95 to 5 wt % of Si, 0.2 to 0.8 wt % of Mg, 0.2 to 1.5 wt % of Zn, 0.2 to 1.5 wt % of Cu, 0.2 to 1.5 wt % of Fe, and between 0.05 and less than 0.6 wt % of Mn, and further comprising one or more members selected from the group consisting of 0.01 to 0.2 wt % of Cr, 0.02 to 0.2 wt % of Ti, 0.01 to 0.2 wt % of Zr, and 0.01 to 0.2 wt % of V, with the balance being aluminum and unavoidable impurities, wherein said method comprises the steps of:

melting the aluminum alloy;

casting the aluminum alloy;

homogenizing the aluminum alloy;

hot-rolling the aluminum alloy;

cold-rolling the aluminum alloy;

annealing the aluminum alloy; and cooling the aluminum alloy at 3° C./sec or above, thereby obtaining the aluminum sheet material and wherein a percent reduction is 98% or above in the production of the aluminum sheet material for automobiles.

* * * * *